United States Patent [19]

Johansson et al.

[11] Patent Number: 4,966,818

[45] Date of Patent: Oct. 30, 1990

[54] METHOD TO CONSOLIDATE A METAL POWDER BODY AND FORGING PRODUCED BY THE METHOD

[75] Inventors: Bertil Johansson, Molkom; Per Hasselström, Söderfors, both of Sweden

[73] Assignee: Uddeholm Tooling Aktiebolag, Sweden

[21] Appl. No.: 346,974

[22] PCT Filed: Sep. 24, 1987

[86] PCT No.: PCT/SE87/00429

§ 371 Date: Apr. 11, 1989

§ 102(e) Date: Apr. 11, 1989

[87] PCT Pub. No.: WO88/03449

PCT Pub. Date: May 19, 1988

[30] Foreign Application Priority Data

Nov. 14, 1986 [SE] Sweden ..... 8604876

[51] Int. Cl.[5] ..... B22F 7/04

[52] U.S. Cl. ..... 482/558; 419/8; 419/38; 419/57; 428/553; 428/554

[58] Field of Search ..... 419/57, 38, 8; 428/553, 428/554, 558

[56] References Cited

U.S. PATENT DOCUMENTS 4,216,017 8/1980 Carcey ..... 75/226

*Primary Examiner*—Stephen J. Lechert, Jr.

[57] ABSTRACT

This invention relates to a method to consolidate a metal powder body to a completely dense body, in which a plate capsule consisting of a cylindrical wall and in one end thereof an end plate is charged with said powder so that the powder completely or essentially completely will fill the capsule, whereafter the air optionally is evacuated from the capsule and optionally replaced with a non-oxidizing protective gas, said capsule thereafter being closed also in the opposite end by an end plaate, whereafter the capsule with its content is heated to a forging temperature suitable for the metal powder and is forged so that the powder is consolidated to a completely dense body.

10 Claims, 2 Drawing Sheets

METHOD TO CONSOLIDATE A METAL POWDER BODY AND FORGING PRODUCED BY THE METHOD

TECHNICAL FIELD

This invention relates to a method to consolidate a metal powder body to a completely dense body, in which a plate capsule consisting of a cylindrical wall and in one end thereof an end plate is charged with said powder so that the powder completely or essentially completely will fill the capsule, whereafter the air optionally is evacuated from the capsule and optionally replaced with a non-oxidizing protective gas, said capsule thereafter being closed also in the opposite end by an end plate, whereafter the capsule with its content is heated to a forging temperature suitable for the metal powder and is forged so that the powder is consolidated to a completely dense body.

BACKGROUND OF THE INVENTION

Prior to forging, the powder in the above described method has a relative density of not more than about 70%, while the capsule material is completely homogenous. When one starts forging on the capsule, the powder initially is compacted but nothing else happens with the capsule than its being deformed, often to an irregular shape. The capsule in other words becomes too large for its contents. During the initial phase of the forging process, the powder, therefore, will be compacted while the capsule only will be "wrinkled". During this initial phase the relative density of the powder will increase from about 70% to a about 97 to 98%, as is the case when, by way of example, a high alloyed tool steel is concerned. The problems with the "wrinkling" to some extent can be overcome by using a forging machine of the type having tools movable in four radial directions as according to U.S. Pat. No. 3 165 012, or by forging in a closed tool as according to U.S. Pat. No. 4 038 738. If, on the other hand, a round capsule shall be forged to a shape having a square section, the complex of problems will be accentuated. This also concerns the next phase of the process when the powder body is almost dense. During this phase the powder body begins to elongate, very much in the same mode as a homogenous material would do. The contents in the capsule then begins to fill the capsule again and there is an aim during the whole of this phase to keep contact between the capsule wall and the contents in the capsule in order to avoid cooling of the capsule which would cause inhomogenities in the material.

In the described process the end plates, which are welded to the ends of the cylindrical walls, are deformed during the forging operation, such that the end portions are strangely wrinkled, which is a great problem. If, by way of example, a flat end plate is welded to the inside of the cylindrical wall, as is shown in FIG. 1, the end wall will bulge as indicated by the arrows. When the forging is finished the weld will be positioned on the cylindrical wall. This implies that the weld has been bent 90° from the rear side of the weld in the weld zones which are very sensitive to cracking. At the same time the weld is subjected to great tensile stresses. As a result the weld joints will easily crack so that air can penetrate the interior of the capsule before the material has become completely dense. The powder will thus be oxidized, which will cause refusal.

In order to avoid bendings and heavy tensile stresses in the weld joints one may instead consider to make the weld joint in the region of the cylindrical wall from the very beginning. The end plate for example may be designed as the end wall of a pressure vessel, FIG. 2. In this case, however, it will be difficult to completely fill the capsule with powder, which creates a secondary problem. It is, per se, easy to fill a capsule on a small scale, but it is more difficult to do it in practice. The angle of repose of the powder is namely such that it is difficult to fill the powder all the way into the corners, even if a hole is made in the end wall which later is plugged up.

In experiments with end plates according to FIGS. 1 and 2 the end plates bulged already in the first forging steps. As already mentioned the capsule initially will be "too big". If at the same time the end walls will bulge, the capsule will become much bigger than the not completely compacted powder body. This implies that the capsule will get poor contact with the powder at the ends. This in its turn implies that the end portions of the capsule will be cooled. The end portions, in other words, will become cold and rigid while the cylindrical wall portion will remain hot and ductile. Between, on one hand, this cold and rigid end portions and, on the other hand, the hot and ductile cylindrical wall the weld joint is situated, which therefore also in this case runs the risk of being subjected to such heavy stresses that it may crack. In this case there is thus a risk that the capsule will break at the weld joint and also a risk for inhomogenities in the material because of lost contact between the capsule and the powder body.

BRIEF DESCRIPTION OF THE INVENTION

The object of the invention is to solve the above mentioned problems. This can be achieved therein that the end plates are substantially prevented from bulging during the forging and thereby losing contact with the powder before the powder has been compacted to at least near complete density through stiffening of the central portions of the end plates and providing them with anchoring means in the form of one or more members projecting to a certain depth into the powder body and/or providing them with one or more intrusion indentations. Preferably there are used capsules in which each end wall is provided with at least one stiffening turned to the interior of the capsule. These stiffenings, at the same time may constitute anchoring means which are embedded in the powder in the capsule and anchored in the capsule at a depth of between 30 and 120 mm when the powder is compacted during the forging. The end plates in other respects can be made completely flat and be welded to the cylindrical wall in the region of the edge between the cylindrical wall and the end plate.

Further features and aspects of the invention will be apparent from the appending claims and from the following description of a preferred embodiment.

BRIEF DESCRIPTION OF THE DRAWINGS

In the foregoing description of the background of the invention reference has been made to FIG. 1 and FIG. 2 which illustrate the end portions of a pair of capsules filled with powder, having designs which are not within the scoop of the invention.

DESCRIPTION OF PREFERRED EMBODIMENTS

Figure 1:
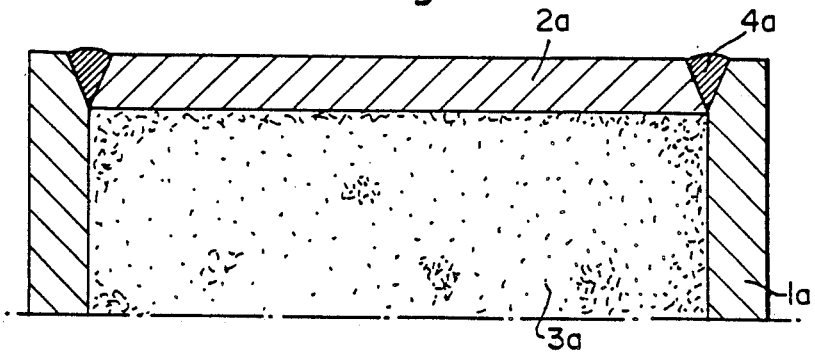
Figure 2:
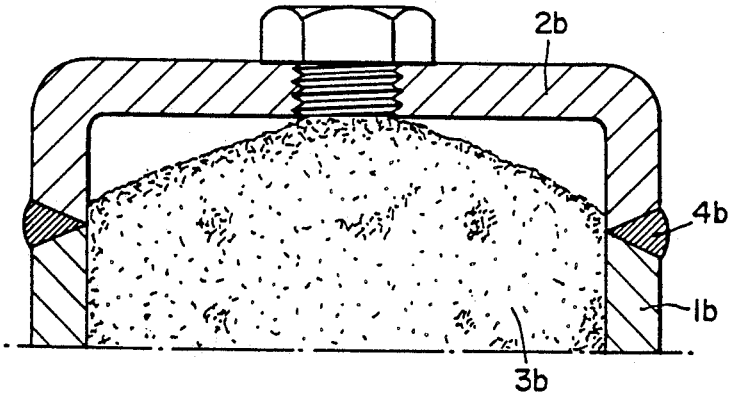

The non-preferred embodiments according to FIGS. 1 and 2 have already been discussed in the description of the background of the invention. Here, therefore, only the complementary explanation will be made that the cylindrical wall of the capsule in FIG. 1 has been designated 1*a*, one of its end plates has been designated 2*a*, while the powder in the capsule has been designated 3*a*. A weld joint between the cylindrical wall 1*a* and the end plate 2*a* has been designated 4*a*. The same reference numerals have been used in FIG. 2 with the letter a having been replaced by the letter b.

Figure 3:
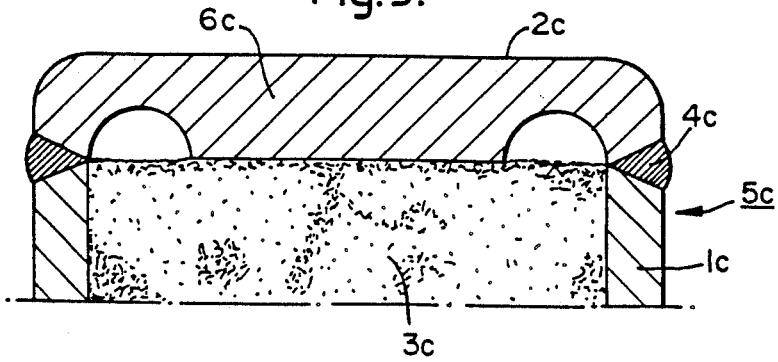
FIG. 3 illustrates a first conceivable embodiment of the end portion of a capsule which may be used according to the invention.

In the embodiment illustrated in FIG. 3 the centre portion 6*c* of an end plate 2*c* was considerably thicker than in the two foregoing embodiments. The capsule 5*c* consisting of the cylindrical wall 1*c*, two end plates 2*c* (one at each end) and the content 3*c* in this case was intended to be tested during laboratory conditions, i.e. not in a full scale. The capsule, therefore, only had an outer diameter of 115 mm, while the centre portion 4*c* of the end wall 2*c* had the thickness 20 mm. The weld joints 4*c* were provided on the outside of the capsule in the transition region between the cylindrical wall 1*c* and the end plates 2*c*.

After heating to forging temperature the capsule 5*c* was subject to forging between flat tools. It was shown that the end plates 2*c* were bent inwards—were intruded—instead of bulging outwards as according to the embodiments according to FIGS. 1 and 2. Successively also in this case wrinkles and complex shapes were established in the end portions but before this occurred the powder had been compacted to a density of at least 90 to 95%. During the whole forging operation until this density had been achieved the capsule plate was snug against the powder which was a desired effect.

It was however difficult to fill the capsule completely when the end plates had a design according to FIG. 3. This problem was solved through the embodiment according to FIGS. 4 and 5. On the inside of each of the in other respects completely flat end plates 2*d* there was fastened a ring 7*d* through welding. The ring was turned inwards towards the interior of the capsule and was pressed down into the powder 3*d* to a depth of about 75 mm. When the air in the capsule had been evacuated and replaced with protective gas the end plates 2*d* were secured through weld joints 4*d* in the terminating edges of the cylindrical wall 1*d*. The forging blank in the form of the capsule 5*d* in this case had full size for production conditions. The outer diameter of the capsule was about 500 mm. When forging between flat forging tools those problems which previously had been encountered did not arise. The end plates 2*d* did not bulge out but maintained its contact with the powder 3*d* in the capsule during the whole period of time. In that way the weld joints 4*d* all the time remained soft and flexible during the forging and any inhomogenities because of variations with reference to the density in the end portions did not arise.

In order to improve the ability of the anchoring means, according to the example the rings 7*d*, to be secured in the powder body 2*d* during the forging operation, the entering means may be provided with nibs 8*d*, grooves or other projections or unevennesses.

Figure 4:
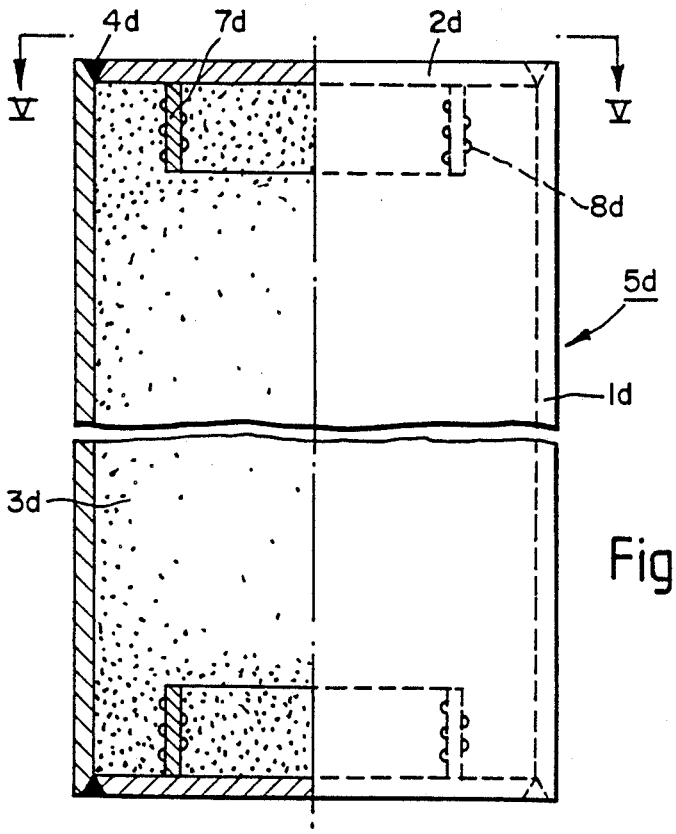
FIG. 4 shows in the right hand part a side view of a capsule having a preferred embodiment of the invention and in the left hand part a section through the same capsule coinciding with a longitudinal line of symmetry.
Figure 5:
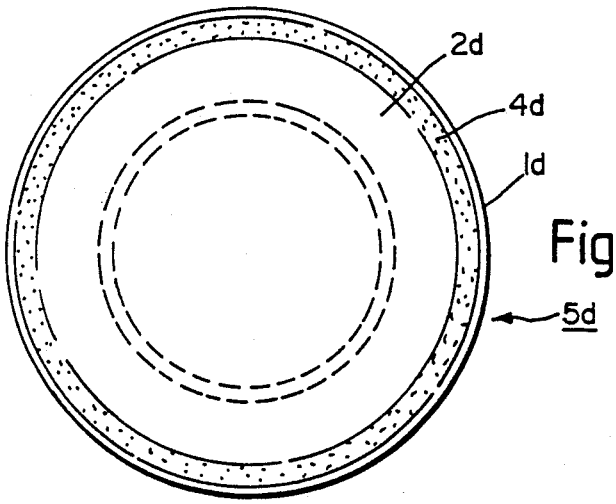
FIG. 5 is an end view V—V in FIG. 4.

It should be realized that FIGS. 4 and 5 illustrate only one among many conceivable embodiments based on the same principle. For example one may, i.e. depending on the diameter of the capsule, use two or more concentric rings as entering and stiffening means. Instead of one or more rings one may also provide other stiffening and anchoring means on the inside of the end plates 2*d*. For example the ring 7*d* or the rings may be replaced by a pair of cross bracings in the form of plate members welded to the inside of the end plates 2*d*. They can also be replaced by a number of short bars, e.g. short pieces of reinforcing bars welded to the inside and extending into the powder 3*d* such that the grooves of corresponding unevennesses effectively are anchored in the powder body when the powder is compacted. It should also be realized that the shown ring or the other said stiffening means may be provided with grooves, nibs or other projections or recesses which make the anchoring in the powder body more efficient. It is also realized that the anchoring means may by united with the inside of the end plates 2*d* in other modes than through welding, e.g. by being screwed into thread holes in the plate. The anchoring means also may consist of integrated parts of the end plates, e.g. of folded tongues or the like.

We claim:

1. A method for the consolidation of a metal powder body to a completely dense body comprising the steps of:

(a) charging a plate capsule, consisting of a cylindrical wall and in one end thereof an end plate, with metal powder so that the powder at least essentially completely fills the capsule;

(b) closing the opposite end of said capsule by a second end plate;

(c) heating the capsule and its contents to a forging temperature suitable for the metal; and (d) forging to consolidate the powder to a completely dense body while substantially preventing the end plates from bulging during forging and thereby losing contact with the powder before the powder has been compacted to at least near complete density by stiffening the central portions of the end plates by at least one stiffening member wherein said stiffening member is welded to the inside of an end plate along a substantial length thereof to stiffen said end plate, and wherein said stiffening member projects into the powder body to a depth sufficient to anchor the end plate in the powder body.

2. Method according to claim 1 further comprising evacuating air from the capsule following charging of the capsule.

3. Method according to claim 2 further comprising replacing the evacuated air with a non-oxidizing protective gas.

4. Method according to claim 3, wherein the stiffening member is embedded in the powder in the capsule and anchored in said powder at depth of between 5 and 30, of the original diameter or breadth of the capsule prior to forging to compact the powder.

5. Method according to any one of claims 1–4 characterized in that the end plates (2*d*) which are substantially flat, are welded to the cylindrical wall in the edge between said wall and said end plate.

6. Method according to any one of claims 1–4 characterized in that a ring (*7d*) is used as a stiffening member in each end of the plate capsule, said ring being concentrically welded to the inside of the end plate.

7. Forged blank consisting of a plate capsule with end walls having at least one stiffening member which is welded to and extends along at least an essential length of the inside of the end plate and is embedded in and united with the powder body at a depth of between 5 and 35% of the original diameter or breadth of the capsule prior to forging, said powder body being consolidated to complete density in the capsule.

8. Method according to claim 4 wherein the stiffening member is embedded and anchored in said powder body at a depth between 8 and 25% of the original diameter or breadth of the capsule prior to forging to compact the powder.

9. A forged blank according to claim 7 where the stiffening member is embedded in and united with the powder body at a depth of between 8 and 25% of the original diameter or breadth of the capsule prior to forging, said powder body being consolidated to complete density in the capsule.

10. Forged blank according to claims 7 or 5, characterized in that the stiffening member (*7d*) in each end consists of a ring welded to the inside of the end plate.

* * * * *